US011846056B2

(12) United States Patent
Wayment

(10) Patent No.: US 11,846,056 B2
(45) Date of Patent: Dec. 19, 2023

(54) HANDLE VIBRATION DAMPENER

(71) Applicant: Gracewood Management, Inc., West Valley City, UT (US)

(72) Inventor: Cody Wayment, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 0 days.

(21) Appl. No.: 17/657,665

(22) Filed: Apr. 1, 2022

(65) Prior Publication Data

US 2022/0316119 A1 Oct. 6, 2022

Related U.S. Application Data

(60) Provisional application No. 63/169,610, filed on Apr. 1, 2021.

(51) Int. Cl.
*D05B 69/32* (2006.01)

(52) U.S. Cl.
CPC ..... *D05B 69/32* (2013.01)

(58) Field of Classification Search
CPC ..... D05B 69/00
See application file for complete search history.

(56) References Cited

U.S. PATENT DOCUMENTS

| | | | | |
|---|---|---|---|---|
| 2,341,821 | A * | 2/1944 | Schwinn | B62K 21/14 403/228 |
| 3,525,373 | A | 8/1970 | Kobayashi | |
| 4,819,742 | A | 4/1989 | Driggers | |
| 5,029,888 | A * | 7/1991 | Allsop | B62J 1/04 248/598 |
| 6,953,201 | B1 * | 10/2005 | VanDeMortel | B62K 21/14 280/279 |
| 2006/0112866 | A1 * | 6/2006 | Pfeifer | D05B 11/00 112/117 |
| 2013/0190916 | A1 * | 7/2013 | Schnaufer | D05B 19/12 700/137 |
| 2016/0108572 | A1 * | 4/2016 | McKinney | D05B 69/32 74/574.2 |
| 2019/0352824 | A1 * | 11/2019 | Groelz | D05B 11/00 |

FOREIGN PATENT DOCUMENTS

| | | | | |
|---|---|---|---|---|
| DE | 19946018 A1 * | 6/2000 | | D05B 55/00 |

* cited by examiner

*Primary Examiner* — Ismael Izaguirre
(74) *Attorney, Agent, or Firm* — Ryan L. Marshall; Jessica Kiser; Barnes & Thornburg LLP

(57) ABSTRACT

A sewing machine comprising a sewing machine body, a needle bar, and a handlebar vibration dampener is disclosed. The sewing machine body includes a sewing machine head and a handlebar assembly coupled to the sewing machine head. The needle bar is attached to the sewing machine head and configured to linearly reciprocate relative to the sewing machine head along a needle bar axis. The handlebar vibration dampener is located between the handlebar assembly and the sewing machine head to reduce vibrations transmitted by the sewing machine head to the handlebar assembly during use of the sewing machine.

20 Claims, 6 Drawing Sheets

HANDLE VIBRATION DAMPENER

CROSS-REFERENCE TO RELATED APPLICATIONS

This application claims the benefit of U.S. provisional application 63/169,610 filed on Apr. 1, 2021, the disclosure of which is hereby incorporated in its entirety by this reference.

FIELD OF DISCLOSURE

The present disclosure relates generally to sewing or quilting machines, and more specifically to handles for sewing or quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern. They are also subject to vibrational feedback making it more difficult for the user to precise control movement of the machine.

SUMMARY

The present disclosure may comprise one or more of the following features and combinations thereof.

A sewing machine may comprise a sewing machine body, a needle bar, and a handlebar vibration dampener. The needle bar may be attached to the sewing machine body and may be configured to linearly reciprocate relative to the sewing machine body along a needle bar axis. The handlebar vibration dampener may be configured to reduce vibrations of the handlebar caused by movement of the needle bar during use of the sewing machine.

In some embodiments, the sewing machine body may comprise a sewing machine head and a handlebar assembly. The sewing machine heat may include an outer case and a head bracket located in the outer case. The handlebar assembly may be coupled to the head bracket of the sewing machine head.

In some embodiments, the handlebar assembly may include a handlebar and a handlebar bracket. The handlebar may be configured to be used by a user to move the sewing machine relative to a work surface. The handlebar bracket may be configured extend between and interconnect the handlebar to the head bracket.

In some embodiments, the needle bar may be attached to the sewing machine head. The needle bar may be configured to linearly reciprocate relative to the sewing machine head along the needle bar axis.

In some embodiments, the handlebar vibration dampener may be located between the handlebar bracket and the head bracket. The handlebar vibration dampener may be configured to reduce vibrations of the handlebar caused by movement of the needle bar during use of the sewing machine.

In some embodiments, the handle vibration dampener may comprise an elastic material. The elastic material may be configured to adsorb the vibrations of the head bracket and prevent the vibrations from transferring to the handle bracket and the handlebars. In some embodiments, the elastic material may be rubber.

In some embodiments, the handle vibration dampener may have a thickness between about 2 millimeters and about 4 millimeters. In some embodiments, the thickness of the handle vibration dampener may be exactly 2 millimeters.

In some embodiments, the handlebar bracket may include a handlebar mount portion, a bracket mount portion, and an interconnecting portion. The handlebar mount portion may extend around and engage the handlebar. The bracket mount portion may be located in spaced apart relation to the handlebar mount portion and couple to the head bracket. The interconnecting portion may extend between and interconnect the handlebar mount portion and the bracket portion. The handle vibration dampener may be located between the bracket mount portion of the handlebar bracket and the head bracket.

In some embodiments, the handle vibration dampener may have a predetermined thickness. The predetermined thickness may space the bracket mount portion apart from the head bracket.

In some embodiments, the predetermined thickness may be between about 2 millimeters and about 4 millimeters. In some embodiments, the predetermined thickness of the handle vibration dampener is exactly 2 millimeters.

In some embodiments, the handlebar assembly may further include fasteners. The fasteners may extend through the head bracket and the handle vibration dampener into the bracket mount portion of the handlebar bracket.

According to another aspect of the present application, a sewing machine may comprise a sewing machine head, a handlebar assembly, and a handlebar vibration dampener. The handlebar assembly may be coupled to the sewing machine head. The handlebar vibration dampener may be configured to reduce vibrations transmitted by the sewing machine head to the handlebar assembly during use of the sewing machine.

In some embodiments, the handlebar assembly may include a handlebar and a handlebar bracket. The handlebar may be configured to be used by a user to move the sewing machine relative to a work surface. The handlebar bracket may be configured extend between and interconnect the handlebar to the sewing machine head.

In some embodiments, the handlebar vibration dampener may be located between the handlebar bracket and the sewing machine head. The handlebar vibration dampener may be configured to reduce vibrations transmitted by the sewing machine head to the handlebar during use of the sewing machine.

In some embodiments, the handle vibration dampener may comprise an elastic material. The elastic material may be configured to adsorb the vibrations of the head bracket and prevent the vibrations from transferring to the handle bracket and the handlebars. In some embodiments, the elastic material may be rubber.

In some embodiments, the handle vibration dampener may have a thickness between about 2 millimeters and about 4 millimeters. In some embodiments, the thickness of the handle vibration dampener may be exactly 2 millimeters.

In some embodiments, the sewing machine head may include an outer case and a head bracket. The head bracket may be located in the outer case. The head bracket may be coupled to a portion of the drive system. In some embodiments, the handle vibration dampener may be located between the handlebar bracket and the head bracket.

In some embodiments, the handlebar bracket may include a handlebar mount portion, a bracket mount portion, and an interconnecting portion. The handlebar mount portion may extend around and engage the handlebar. The bracket mount portion may be located in spaced apart relation to the handlebar mount portion and couple to the head bracket. The interconnecting portion may extend between and interconnect the handlebar mount portion and the bracket portion. In some embodiments, the handle vibration dampener may be located between the bracket mount portion of the handlebar bracket and the head bracket.

In some embodiments, the handle vibration dampener may have a predetermined thickness between about 2 millimeters and about 4 millimeters. In some embodiments, the predetermined thickness of the handle vibration dampener may be exactly 2 millimeters.

According to another aspect of the present disclosure, a method of reducing the vibrations to a handlebar of a moveable sewing machine may comprise providing a sewing machine. The sewing machine may comprise a sewing machine head and a handlebar assembly.

In some embodiments, the handlebar assembly may comprise a handlebar and a handlebar bracket. The handlebar may be configured to be used by a user to move the sewing machine relative to a work surface. The handlebar bracket may be configured to couple the handlebar to the sewing machine head.

In some embodiments, the handlebar bracket may include a handlebar mount portion, a bracket mount portion, and an interconnecting portion. The bracket mount portion may be located in spaced apart relation to the handlebar mount portion. The interconnecting portion may extend between and interconnect the handlebar mount portion and the bracket portion.

In some embodiments, the method may further comprise providing a handlebar vibration dampener. The handlebar vibration dampener may be configured to reduce vibrations transmitted by the sewing machine head to the handlebar during use of the sewing machine.

In some embodiments, the method may further comprise coupling the handlebar mount portion of the handle bar bracket to an outer case of the sewing machine head. In some embodiments, the method may further comprise locating the handlebar vibration dampener on the bracket mount portion of the handlebar bracket.

In some embodiments, the method may further comprise coupling the bracket mount portion of the handlebar bracket to the sewing machine head so that the handle vibration dampener is located between the bracket mount portion of the handlebar bracket and the sewing machine head. In some embodiments, the method may further comprise coupling the handlebar to the handlebar mount portion of the handlebar bracket.

These and other features of the present disclosure will become more apparent from the following description of the illustrative embodiments.

DETAILED DESCRIPTION OF THE DRAWINGS

Figure 1:
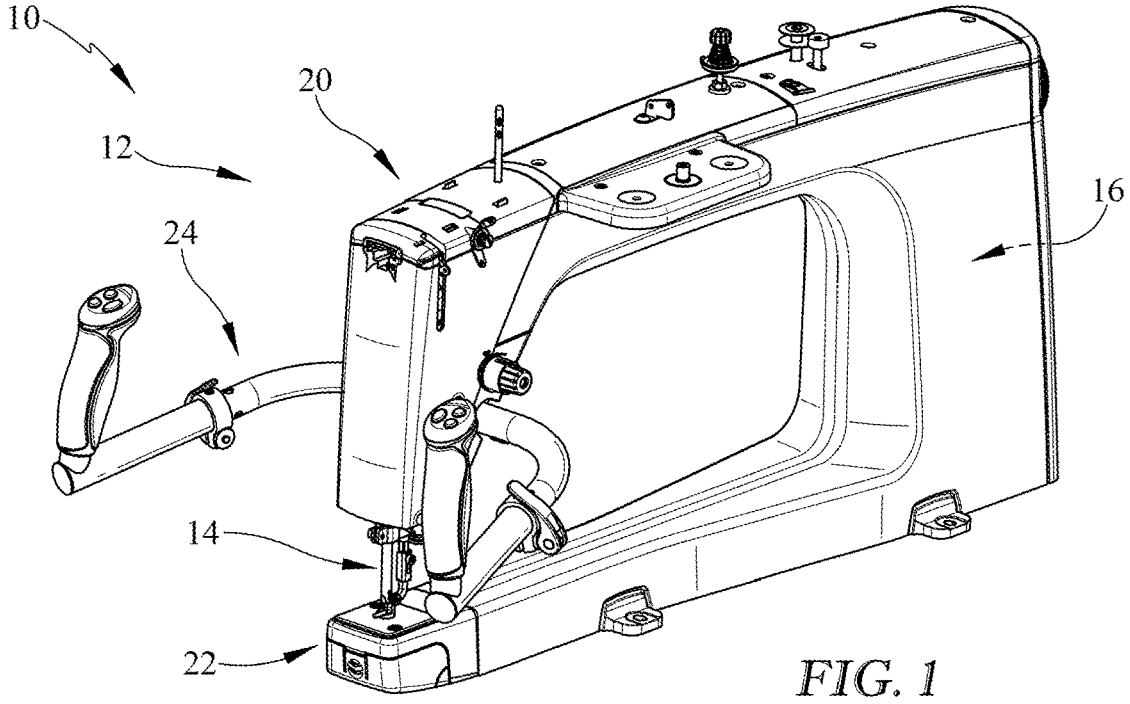
FIG. 1 is a perspective view of a sewing machine including a sewing machine body which has a sewing machine head and a handlebar assembly coupled to the sewing machine head to allow a user to move the sewing machine relative to a work surface, a needle bar attached to the sewing machine head to linearly reciprocate relative to the sewing machine, and a drive assembly configured to cause movement of the needle bar.
Figure 2:
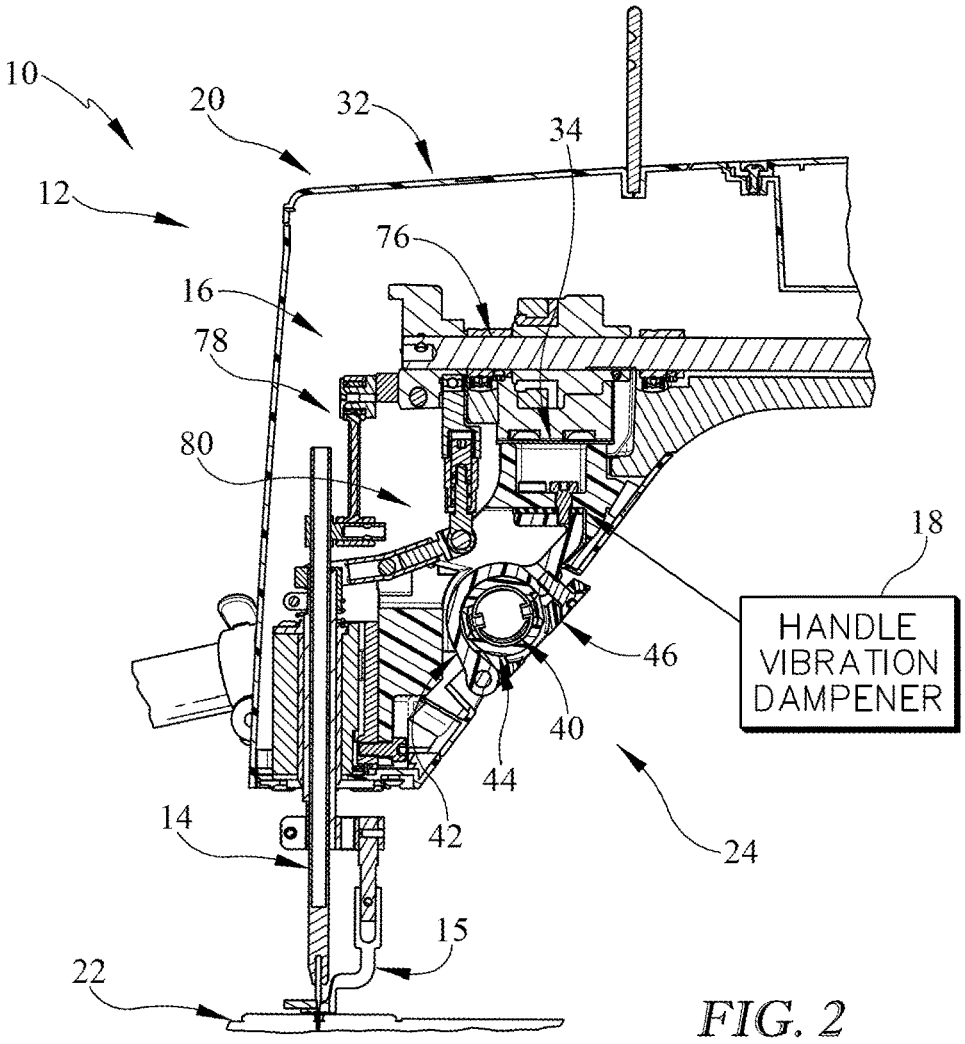
FIG. 2 is a cross-section view of the sewing machine of FIG. 1 taken along line 2-2 showing the sewing machine further includes a handle vibration dampener located between a portion of the handlebar assembly and the sewing machine head to reduce vibrations of the handlebar transmitted by the sewing machine head during use of the sewing machine.

For the purposes of promoting an understanding of the principles of the disclosure, reference will now be made to a number of illustrative embodiments illustrated in the drawings and specific language will be used to describe the same.

An illustrative embodiment of a sewing machine 10 adapted to be freely moveable by a user is shown in FIG. 1. The sewing machine 10 has a sewing machine body 12, a needle bar 14, a drive assembly 16, and a handlebar vibration dampener 18 as shown in FIGS. 1-5. The sewing machine body 12 includes a sewing machine head 20, a sewing machine bed 22, and a handlebar assembly 24 as shown in FIGS. 1-4. The needle bar 14 is attached to the sewing machine head 20 to linearly reciprocate relative to the sewing machine head 20. The drive assembly 16 is configured to cause movement of the needle bar 14 of the sewing machine body 12 to sew different pieces of fabric together. The handlebar vibration dampener 18 is configured to reduce vibrations felt by a user holding the handlebar assembly 24 that are caused by movement of the needle bar 14 driven by the drive assembly 16 during use of the sewing machine 10.

The handlebar assembly 24 is coupled to the sewing machine head 20 and configured to be used by the user to move the sewing machine 10 relative to the fabric to be sewn. During use of a sewing machine 10, the drive system 16 causes the needle bar 14 to linearly reciprocate relative to the sewing machine head 20. The oscillations of the needle bar 14 causes the sewing machine head 20 to vibrate. At certain speeds, the movement of the needle bar 14 causes the sewing machine head 20 to vibrate at its resonance frequency.

As the handlebar assembly 24 is coupled to the sewing machine head 20, the vibrations are transferred from the sewing machine head 20 to a handlebar 40 of the handlebar assembly 24, which is held by the user. The vibration of the handlebar 40 may make it difficult for the user to accurately move the sewing machine 10 along the desired pattern or stitch line. Moreover, if the sewing machine head 20 begins to vibrate at its resonance frequency, the user may have a difficult time controlling the movement of the sewing machine 10 with the handlebar 40.

To reduce the vibration experienced by the user, the sewing machine 10 of the present disclosure includes the handlebar vibration dampener 18 between the sewing machine head 20 and the handlebar assembly 24. The handlebar vibration dampener 18 is located between the sewing machine head 20 and the handlebar assembly 24. The dampener 18 reduces the vibrations caused movement of the needle bar 14 during use of the sewing machine 10 transmitted from the sewing machine head 20 to the handlebar 40. The dampener 18 may also reduce or prevent the sewing machine head 20 from vibrating at its resonance frequency, as suggested in FIGS. 6 and 7, which helps the user control the sewing machine 10.

The handlebar vibration dampener 18 comprises an elastic material in the illustrative embodiment. The elastic material is configured to adsorb the vibrations of the sewing machine head 20. The material absorbs some of the vibrations thereby preventing the vibrations from transferring directly to the handlebar assembly 24. The elastic material of the dampener 18 also prevents the sewing machine head 20 from vibrating at its resonance frequency.

In the illustrative embodiment, the elastic material is rubber. In some embodiments, other suitable elastic material may be used.

In other embodiments, the handle vibration dampener 18 may be a spring located between the sewing machine head 20 and the handlebar assembly 24. In some embodiments, the dampener 18 may be a fluid or gel located between the sewing machine head 20 and the handlebar assembly 24.

Figure 4:
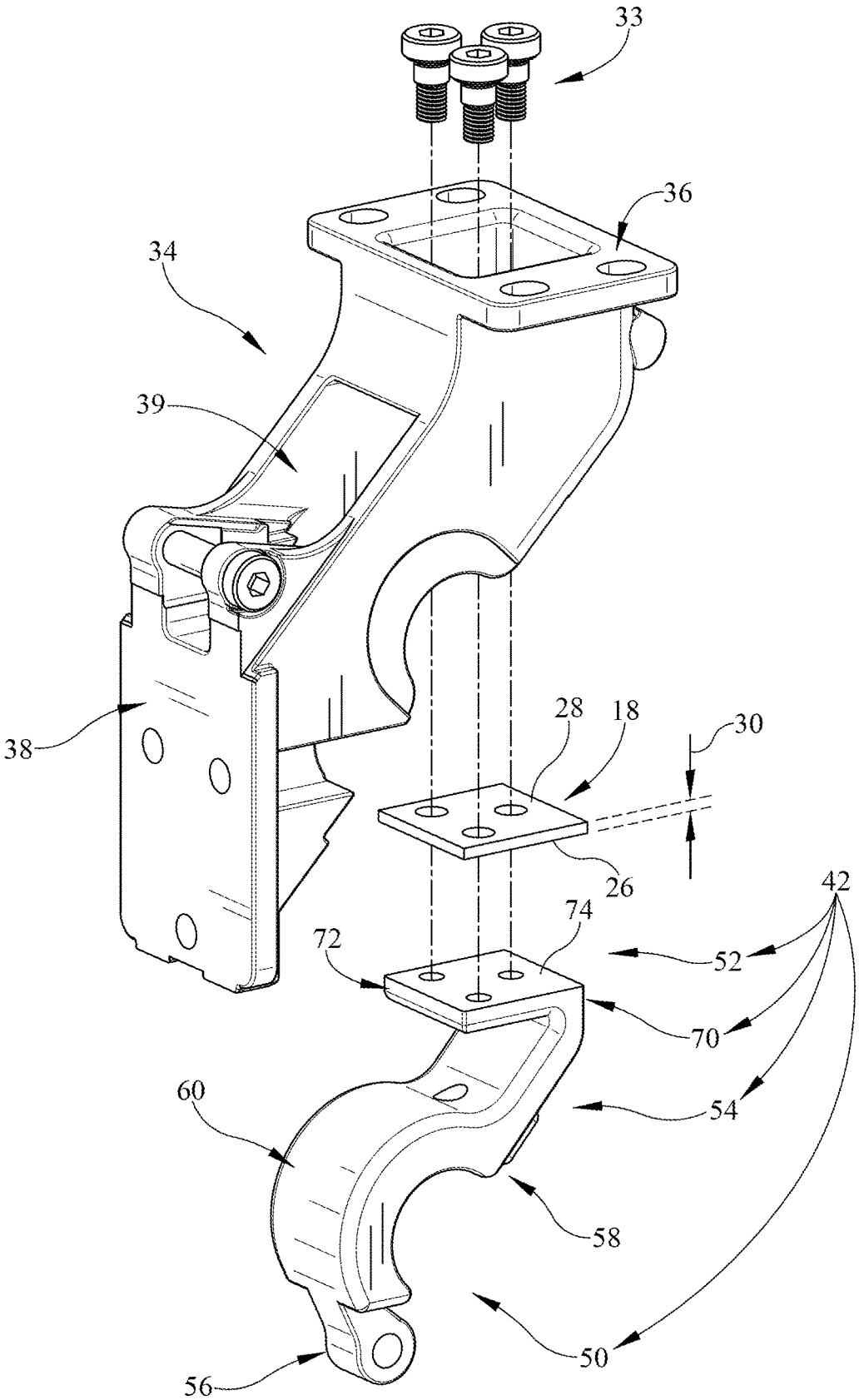
FIG. 4 is exploded detail view of FIG. 3 showing the handlebar bracket includes a handlebar mount portion that extends partway around and engages the handlebar, a bracket mount portion that couples to the head bracket, and an interconnecting portion that extends between and interconnects the handlebar mount portion and the bracket mount portion.
Figure 5:
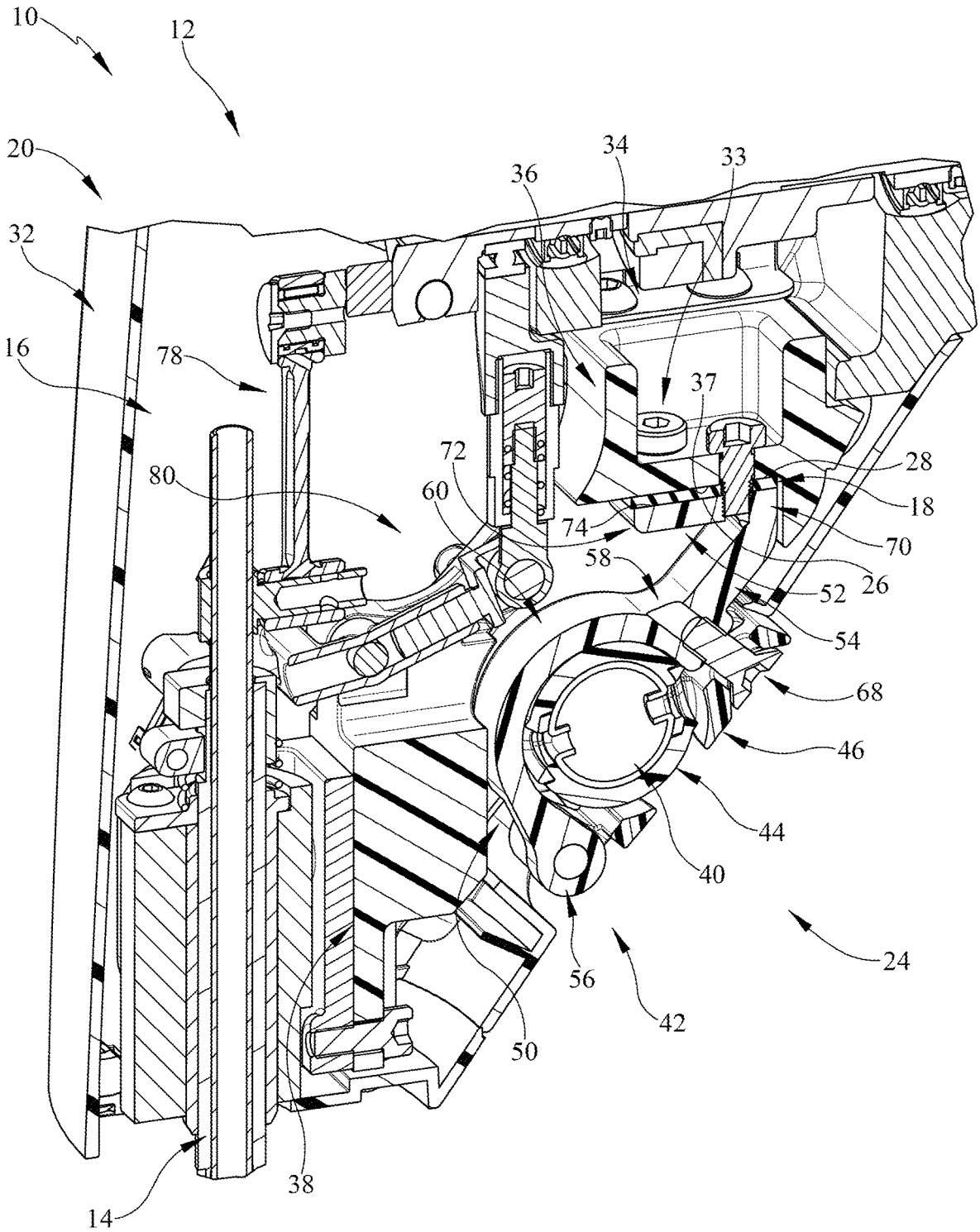
FIG. 5 is a detail view of the sewing machine of FIG. 2 showing the handlebar vibration dampener is located between the bracket mount portion of the handlebar bracket and the head bracket to isolate the handlebar assembly from the head bracket.

In the illustrative embodiment, the dampener 18 is a piece of elastic material that includes a first surface 26 and a second surface 28 as shown in FIGS. 4 and 5. The second surface 28 is spaced apart from the first surface 26 to define a predetermined thickness 30 of the dampener 18. The thickness 30 spaces the handlebar assembly 24 apart from the sewing machine head 20 so as to isolate the handlebar assembly 24 from the sewing machine head 20.

In some embodiments, the handlebar vibration dampener 18 has a thickness 30 between about 2 millimeters and about 4 millimeters. In other embodiments, the thickness 30 is of the handlebar vibration dampener 18 is about 2 millimeters. In the illustrative embodiment, the thickness 30 is of the handlebar vibration dampener 18 is exactly 2 millimeters.

Turning again to the sewing machine body 12, the sewing machine body 12 includes the sewing machine head 20, the sewing machine bed 22, and the handlebar assembly 24 as shown in FIGS. 1-5. The sewing machine head 18 has an outer case 32 that houses a head bracket 34 and a portion of the needle bar 14. The sewing machine bed 22 supports the fabric to be sewn. The handlebar assembly 24 is coupled to the sewing machine head 18. In the illustrative embodiment, the handlebar assembly 24 is coupled to the head bracket 34 of the sewing machine head 18.

The head bracket 34 is shaped to define an upper end 36, a lower end 38, and a space 39 as shown in FIGS. 4 and 5. The upper end 36 may be coupled to a stationary portion of the drive assembly 16 or another part of the sewing machine head 20. The lower end 38 is engaged with a portion of the needle bar 14 in the illustrative embodiment. The space 39 is formed in the head bracket 34 to receive a portion of the handlebar bracket 42.

The handlebar assembly 24 includes including the handlebar 40, a handlebar bracket 42, a mount ring 44, and a handlebar lock 46 as shown in FIGS. 2-5. The handlebar 40 is used by the user to move the sewing machine 10 relative to the work surface. The handlebar bracket 42 is configured extend between and interconnect the handlebar 40 to the sewing machine head 20. In the illustrative embodiment, the handlebar bracket 42 extends between and interconnects the handlebar 40 to the head bracket 34 of the sewing machine head 20. The mount ring 44 extends around the handlebar 40 and is configured to block the handlebar 40 from rotating about an axis relative to the sewing machine head 20. The handlebar lock 46 is configured to lock the handlebar 40 to the handlebar bracket 42.

The handlebar vibration dampener 18 is located between the handlebar bracket 42 and the head bracket 34 in the illustrative embodiment. The first surface 26 of the dampener 18 is engaged with the handlebar bracket 42, while the second surface 28 is engaged with a surface 37 of the head bracket 34. The dampener 18 is configured to reduce vibrations of the handlebar 40 caused movement of the needle bar 14 during use of the sewing machine 10.

Figure 3:
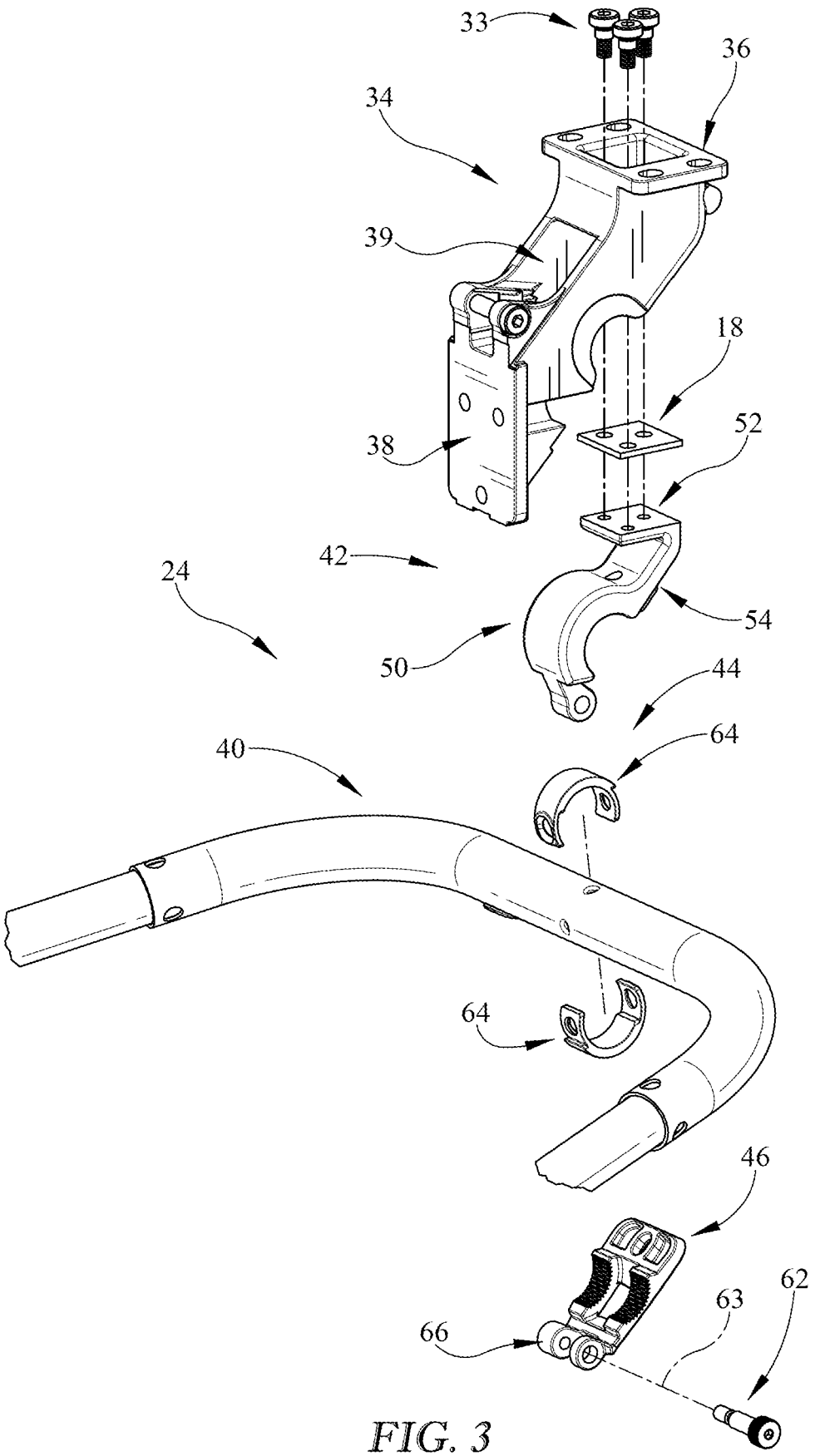
FIG. 3 is an exploded view of a portion of the sewing machine of FIG. 2 showing the handlebar assembly includes a handlebar to be gripped by a user and a handlebar bracket configured extend between and interconnect the handlebar to a head bracket included in the sewing machine head, and showing the handlebar vibration dampener is configured to be arranged between the handlebar bracket and the head bracket.

The handlebar bracket 42 includes a handlebar mount portion 50, a bracket mount portion 52, and an interconnecting portion 54 as shown in FIGS. 3-5. The handlebar mount 50 extends partway around and engages the handlebar 40. The bracket mount 52 is located in spaced apart relation to the handlebar mount 50 and couples to the head bracket 34. The interconnecting portion 54 extends between and interconnects the handlebar mount portion 50 and the bracket mount portion 52.

The handlebar vibration dampener 18 is located between the bracket mount portion 52 of the handlebar bracket 42 and the head bracket 34 as shown in FIGS. 3-4. The first surface 26 of the dampener 18 is engaged with the bracket mount portion 52, while the second surface 28 of the dampener 18 is engaged with the surface 37 of the head bracket 34. The dampener 18 isolates the handlebar bracket 42 of the handlebar assembly 24 from the head bracket 34.

The handlebar bracket 42 is only engaged with the head bracket 34 at the bracket mount portion 52 as shown in FIGS. 1 and 5. The space 39 in the head bracket 34 is sized to receive the rest of the handlebar bracket 42 so that no other part of the handlebar bracket 42 engages the head bracket 34.

The handlebar mount portion 50 of the handlebar bracket 42 includes a first end 56, a second end 58, and a curved section 60 as shown in FIGS. 4 and 5. The first end 56 is pivotally coupled to the sewing machine head 20. The second end 58 is connected to the interconnecting portion 54. The curved section 60 extends between and interconnects the two ends 56, 58 and has a curved shape that follows the curvature of the handlebar 40. The curved section 60 extends partway around the handlebar 40.

In the illustrative embodiment, the mount ring 44 is located between the curved section 60 of the handlebar mount 50 and the handlebar 40. The mount ring 44 is defined by two half-circle pieces 64 as shown in FIG. 3. The mount ring 44 is secured to the handlebar 40 with fasteners.

In the illustrative embodiment, the handlebar lock 46 includes notch 66 as shown in FIG. 3. The notch 66 receives the first end 56 of the handlebar mount portion 50 of the bracket 42. The pin 62 that couples the first end 56 of the handlebar mount portion 50 extends through the lock 46 and the first end 56 and into the outer case 32. In this way, the lock 46 is pivotable about the same axis 63 as the bracket 42.

The bracket mount portion 52 includes a first end 70, a second end 72, and a mount surface 74 as shown in FIGS. 3-4. The bracket mount portion 52 is connected to the interconnecting portion 54 at the first end 70 and extends to the second end 72 that is spaced apart from the first end 70. The mount surface 74 extends between and interconnects the two ends 72, 74. The mount surface 74 engages with the first surface 26 of the dampener 18 in the illustrative embodiment.

In the illustrative embodiment, the sewing machine had 16 further includes fasteners 33 that extend through the head bracket 34 and the dampener 18 into the bracket mount portion 52 of the handlebar bracket 42. The fasteners 33 couple the components together.

Turning again to the sewing machine 10, the drive system 16 includes a motor (not shown), a drive shaft 76, and linkages 78, 80 as shown in FIGS. 1 and 5. The drive shaft 76 is coupled to the motor to be driven by rotation of the motor. The linkages 78, 80 are coupled to the drive shaft 76 and the needle bar 14. The linkage 78 is coupled to the needle bar 14 and drives the linear oscillation of the needle bar 14, while the other linkage 80 is coupled to a pressure foot 15 of the sewing machine 10 that holds the hopping foot.

In the illustrative embodiment, the upper end 36 of the head bracket 34 is in close proximity to the drive shaft 76 of the drive assembly 16, while the lower end 38 is engaged with a portion of the drive assembly 16 surrounding the needle bar 14.

Figure 6:
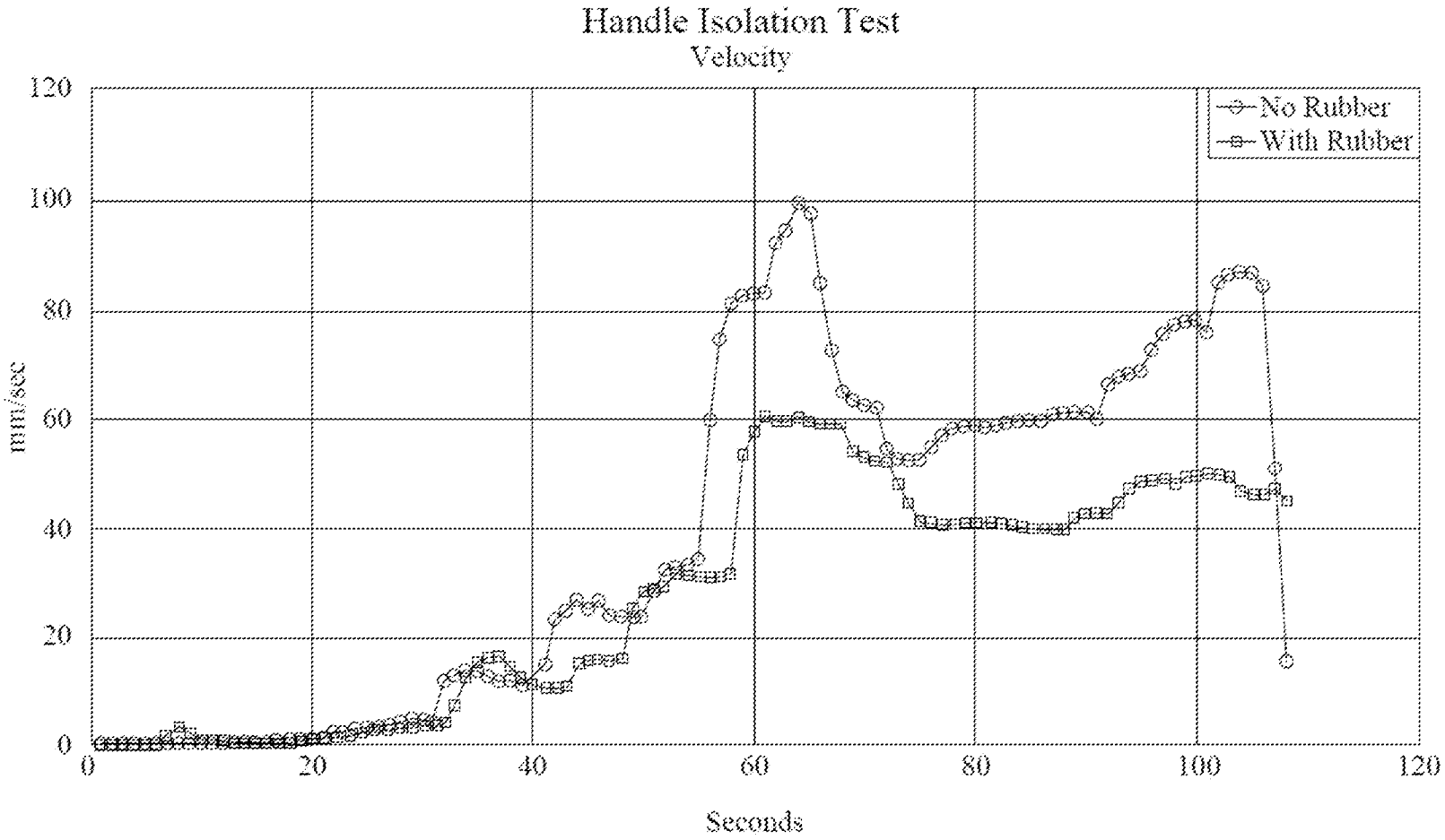
FIG. 6 is a graph of the velocity of the handlebar assembly included in the sewing machine of FIG. 1 over a test period.
Figure 7:
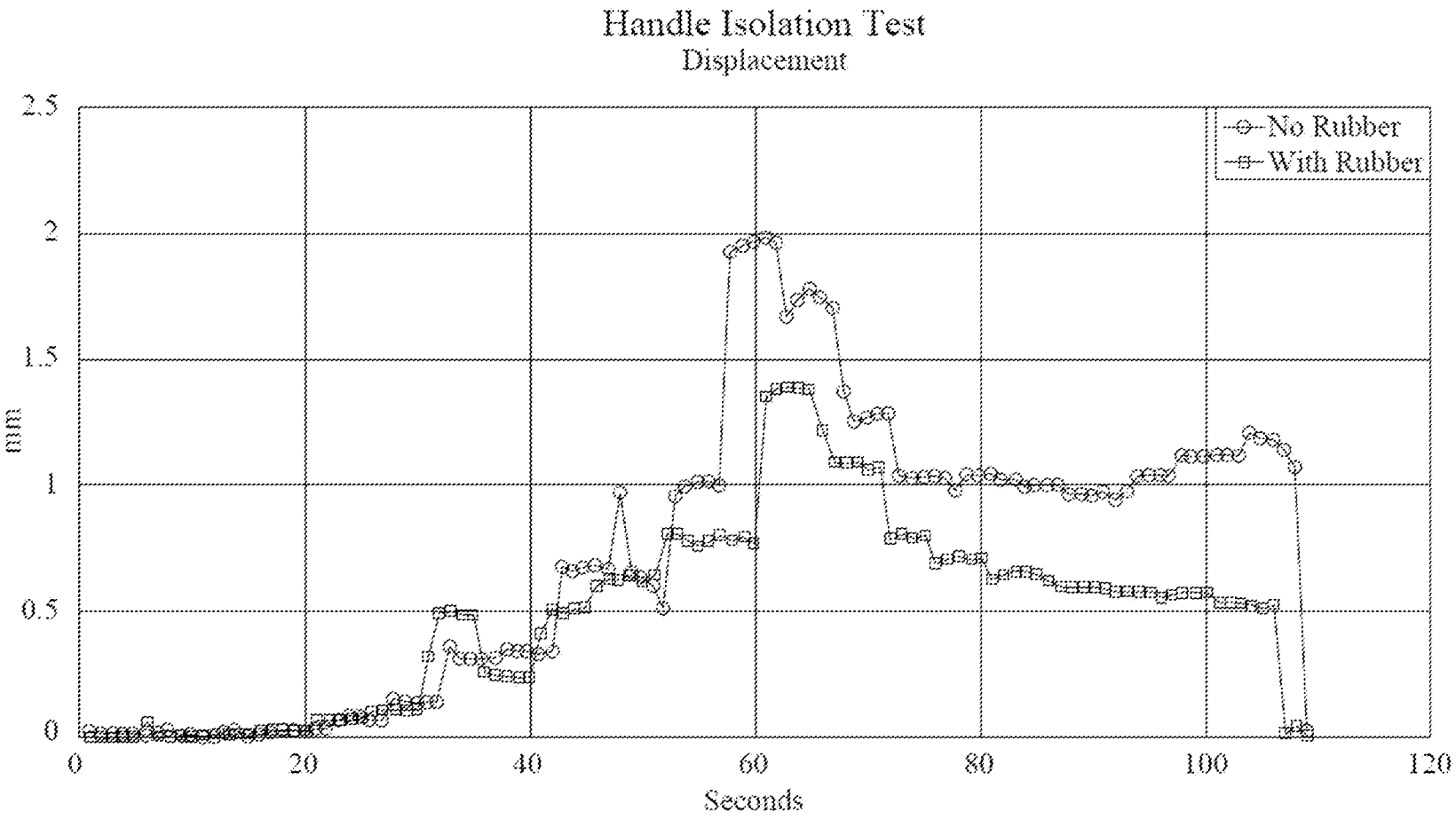
FIG. 7 is a graph of the displacement of the handlebar assembly included in the sewing machine of FIG. 1 over the test period.

Different tests were completed to show the dampener 18 reduces the vibration of the sewing machine head 20. The results of the each test is shown in FIGS. 6 and 7. For each test, a vibration sensor was attached to either the sewing machine head 20 or the handlebar 40.

The sensor measured the acceleration, velocity, and displacement of either the sewing machine head 20 or the handlebar 40 (i.e. which component the sensor was coupled to). The measured velocity of the handlebar 40 over the test run time is shown in FIG. 6. The measured displacement of the handlebar 40 over the test run time is shown in FIG. 7.

Once the sensors were recording, the drive system 16 was turned on at the slowest speed. The speed of the motor included in the drive system 16 was increased in 5% increments every 5 seconds.

The speed was increased until a maximum speed of the drive system 16 was reached. At the point of maximum speed, the drive machine was allowed to run at the maximum speed for 5 seconds before the drive system 16 was turned off.

As shown in FIG. 6, for a first test run without the vibration dampener 18 installed the handlebar 40 experienced a maximum velocity of about 100 millimeters per second (mm/s). Conversely, in a second test run with the vibration dampener 18 installed, the handlebar 40 experienced a maximum velocity of about 60 mm/s.

It can also be noticed from FIG. 6, that without the vibration dampener 18, the handlebar 40 begins to reach a resonance frequency about one minute into the test run. At this point during the test, the speed of the drive assembly 16 has not been turned up to the maximum speed. The maximum speed of the drive assembly 16 is reached at about 100 seconds into the test run.

As shown in FIG. 6, the dampener 18 reduces the velocity of the handlebar assembly 24 and prevents the sewing machine head 20 from reaching its resonance frequency. After the maximum velocity at about one minute into the test run, the dampener 18 causes the sewing machine head 20 to remain at a steady state velocity of about 40 mm/s to about 55 mm/s.

As shown in FIG. 7, for a third test run without the vibration dampener 18 installed, the handlebar 40 experienced a maximum displacement of about 2 millimeters. Conversely, in a fourth test run with the vibration dampener 18 installed, the handlebar 40 experienced a maximum displacement of about 1.4 millimeters.

It can also be noticed from FIG. 7, that without the vibration dampener 18, the handlebar 40 begins to reach a resonance frequency about one minute into the test run. At this point during the test, the speed of the drive assembly 16 has not been turned up to the maximum speed. The maximum speed of the drive assembly 16 is reached at about 100 seconds into the test run.

A method of reducing the vibrations to the handlebar 40 of the moveable sewing machine 10 may include several steps. Once the needle bar 14 and the drive assembly 16 are assembled in the sewing machine body 12, the handlebar assembly 24 may be coupled to the sewing machine head 20.

To couple the handlebar assembly 24 to the sewing machine 10, the handlebar mount portion of the handlebar bracket is coupled to the outer case of the sewing machine head. The first end 56 of the handlebar mount portion is coupled to the outer case 32 with the pin or screw 62 such that the handlebar bracket is pivotable relative to the sewing machine head 20.

In the illustrative embodiment, the handlebar lock 46 is coupled to the outer case 32 simultaneously. The first end 56 of the handlebar mount portion 50 is arranged in the notch 66 of the lock 46 so that through holes are aligned in each. The handlebar lock 46 and the bracket 42 are coupled to the outer case 32 by inserting the pin 62 through the handlebar lock 46 and the bracket 42 and into the sewing machine head 20.

The handlebar vibration dampener 18 is located on the bracket mount portion 52 of the handlebar bracket 42 before or after then handlebar mount portion 50 of the bracket 42 is coupled to the sewing machine head 20. The dampener 18 is located on the mount surface 74 so that the first surface 26 of the dampener 18 engages the mount surface 74 in the illustrative embodiment.

The bracket mount portion 52 of the handlebar bracket 42 is then coupled to the sewing machine head 20 so that the handle vibration dampener 18 is located between the bracket mount portion 52 of the handlebar bracket 42 and the sewing machine head 20. The bracket mount portion 52 is coupled to the head bracket 34 in the illustrative embodiment.

In the illustrative embodiment, the handlebar bracket 42 is pivoted until the second surface 28 of the dampener 18 engages the head bracket 34. The second surface 28 of the dampener 18 is engaged with the head bracket 34 and the fasteners 33 arranged to extend through the dampener 18 and into the bracket mount portion 52 to couple the bracket mount portion 52 to the sewing machine head 20.

Once the handlebar bracket 42 is secure, the handlebar 40 is coupled to the handlebar mount portion 50 of the handlebar bracket 42. To couple the handlebar 40 to the handlebar mount portion 50, the mount ring 44 is first coupled to the handlebar 40. The mount ring 44 is then arranged in the curved section 60 of the handlebar mount portion 50.

To secure the handlebar 40 in place, the lock 46 is pivoted to trap the handlebar 40 with the mount ring 44 between the curved section 60 and the lock 46. A fastener 68 then couples the lock 46 to the sewing machine head 20. The sewing machine 10 is then ready for use.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A sewing machine comprising:

a sewing machine body comprising a sewing machine head including an outer case and a head bracket located in the outer case, and a handlebar assembly coupled to the head bracket of the sewing machine head, the handlebar assembly including a handlebar configured to be used by a user to move the sewing machine relative to a work surface and a handlebar bracket configured extend between and interconnect the handlebar to the head bracket, a needle bar attached to the sewing machine head and configured to linearly reciprocate relative to the sewing machine head along a needle bar axis, and a handlebar vibration dampener located between the handlebar bracket and the head bracket, the handlebar vibration dampener configured to reduce vibrations of the handlebar caused by movement of the needle bar during use of the sewing machine.

2. The sewing machine of claim 1, wherein the handle vibration dampener comprises an elastic material that is configured to adsorb the vibrations of the head bracket and prevent the vibrations from transferring to the handle bracket and the handlebars.

3. The sewing machine of claim 2, wherein the elastic material is rubber.

4. The sewing machine of claim 2, wherein the handle vibration dampener has a thickness between about 2 millimeters and about 4 millimeters.

5. The sewing machine of claim 4, wherein the thickness of the handle vibration dampener is exactly 2 millimeters.

6. The sewing machine of claim 1, wherein the handlebar bracket includes a handlebar mount portion that extends around and engages the handlebar, a bracket mount portion located in spaced apart relation to the handlebar mount portion and couples to the head bracket, and an interconnecting portion that extends between and interconnects the handlebar mount portion and the bracket portion, and wherein the handle vibration dampener is located between the bracket mount portion of the handlebar bracket and the head bracket.

7. The sewing machine of claim 6, wherein the handle vibration dampener has a predetermined thickness that spaces the bracket mount portion apart from the head bracket.

8. The sewing machine of claim 7, wherein the predetermined thickness is between about 2 millimeters and about 4 millimeters.

9. The sewing machine of claim 8, wherein the predetermined thickness of the handle vibration dampener is exactly 2 millimeters.

10. The sewing machine of claim 6, wherein the handlebar assembly further includes fasteners that extend through the head bracket and the handle vibration dampener into the bracket mount portion of the handlebar bracket.

11. A sewing machine comprising a sewing machine head, a handlebar assembly coupled to the sewing machine head, the handlebar assembly including a handlebar configured to be used by a user to move the sewing machine relative to a work surface and a handlebar bracket configured extend between and interconnect the handlebar to the sewing machine head, a handlebar vibration dampener located between the handlebar bracket and the sewing machine head, the handlebar vibration dampener configured to reduce vibrations transmitted by the sewing machine head to the handlebar during use of the sewing machine.

12. The sewing machine of claim 11, wherein the handle vibration dampener comprises an elastic material that is configured to adsorb the vibrations of the head bracket and prevent the vibrations from transferring to the handle bracket and the handlebars.

13. The sewing machine of claim 12, wherein the elastic material is rubber.

14. The sewing machine of claim 11, wherein the handle vibration dampener has a thickness between about 2 millimeters and about 4 millimeters.

15. The sewing machine of claim 14, wherein the thickness of the handle vibration dampener is exactly 2 millimeters.

16. The sewing machine of claim 11, wherein the sewing machine head includes an outer case and a head bracket located in the outer case that couples to a portion of the drive system, and wherein the handle vibration dampener is located between the handlebar bracket and the head bracket.

17. The sewing machine of claim 16, wherein the handlebar bracket includes a handlebar mount portion that extends around and engages the handlebar, a bracket mount portion located in spaced apart relation to the handlebar mount portion and couples to the head bracket, and an interconnecting portion that extends between and interconnects the handlebar mount portion and the bracket portion, and wherein the handle vibration dampener is located between the bracket mount portion of the handlebar bracket and the head bracket.

18. The sewing machine of claim 6, wherein the handle vibration dampener has a predetermined thickness between about 2 millimeters and about 4 millimeters.

19. The sewing machine of claim 18, wherein the predetermined thickness of the handle vibration dampener is exactly 2 millimeters.

20. A method of reducing the vibrations to a handlebar of a moveable sewing machine, the method comprising providing a sewing machine comprising a sewing machine head, and a handlebar assembly comprising a handlebar configured to be used by a user to move the sewing machine relative to a work surface, and a handlebar bracket configured to couple the handlebar to the sewing machine head, the handlebar bracket including a handlebar mount portion, a bracket mount portion located in spaced apart relation to the handlebar mount portion, and an interconnecting portion that extends between and interconnects the handlebar mount portion and the bracket portion;

providing a handlebar vibration dampener configured to reduce vibrations transmitted by the sewing machine head to the handlebar during use of the sewing machine;

coupling the handlebar mount portion of the handle bar bracket to an outer case of the sewing machine head;

locating the handlebar vibration dampener on the bracket mount portion of the handlebar bracket;

coupling the bracket mount portion of the handlebar bracket to the sewing machine head so that the handle vibration dampener is located between the bracket mount portion of the handlebar bracket and the sewing machine head; and coupling the handlebar to the handlebar mount portion of the handlebar bracket.

* * * * *